US006564863B1

(12) United States Patent
Martins

(10) Patent No.: US 6,564,863 B1
(45) Date of Patent: May 20, 2003

(54) CONCENTRATED OR DILUTABLE SOLUTIONS OR DISPERSIONS, PREPARATION METHOD AND USES

(75) Inventor: Carlos Martins, Versailles (FR)

(73) Assignee: Valeo Thermique Moteur, La Verriere (FR)

( * ) Notice: Subject to any disclaimer, the term of this patent is extended or adjusted under 35 U.S.C. 154(b) by 0 days.

(21) Appl. No.: 09/720,357

(22) PCT Filed: Apr. 27, 2000

(86) PCT No.: PCT/FR00/00118

§ 371 (c)(1),
(2), (4) Date: Mar. 13, 2001

(87) PCT Pub. No.: WO00/66964

PCT Pub. Date: Nov. 9, 2000

(30) Foreign Application Priority Data

Apr. 28, 1999 (FR) ..... 99 05368

(51) Int. Cl.[7] ..... F28F 9/16

(52) U.S. Cl. ..... 165/175; 165/153; 165/178; 165/173

(58) Field of Search ..... 165/173, 175, 165/153, 178, 906

(56) References Cited

U.S. PATENT DOCUMENTS 3,605,882 A * 9/1971 Smith et al. ..... 165/173
4,193,180 A * 3/1980 Press ..... 165/173
4,678,112 A * 7/1987 Koisuka et al. ..... 165/173
4,709,689 A * 12/1987 Simcox ..... 165/173
6,176,303 B1 * 1/2001 Kobayashi et al. ..... 165/175

FOREIGN PATENT DOCUMENTS

| | | | |
|---|---|---|---|
| DE | 19524052 | 1/1997 | |
| EP | 0586037 | 3/1994 | |
| EP | 0714008 | 5/1996 | |
| EP | 0864840 | 9/1998 | |
| JP | 2-309196 | * 12/1990 | ..... 165/173 |

* cited by examiner

*Primary Examiner*—Leonard Leo

(57) ABSTRACT

A heat exchanger for heat extraction of a refrigerating fluid such as CO2, comprising at least one collecting box defined by a solid body (41) with a thick wall capable of resisting the high pressure of said fluid, and communicating with a row of flat tubes (44). In order to limit bulkiness in the width of the heat exchanger, only one part of the length of the cross section of the tubes is located opposite the inner volume of said body, whereby tightness of the fluidic communication between the tubes and the inner volume is obtained by means of a cradle (50) in the form of a shaped strip receiving the body and brazed thereto on the periphery of the tubes. The heat exchanger can be used to air condition passenger compartments in vehicles.

8 Claims, 3 Drawing Sheets

CONCENTRATED OR DILUTABLE SOLUTIONS OR DISPERSIONS, PREPARATION METHOD AND USES

The invention relates to a heat exchanger comprising at least one manifold the internal volume of which is defined by at least one longitudinal bore formed in an elongate solid body, and is in fluid communication with a row of tubes which are mutually aligned in the axial direction of the bore or bores, elongate parallel to one another in a first direction substantially perpendicular to the said axial direction and having an elongate cross section in a second direction substantially perpendicular to the axial direction and substantially perpendicular to the said first direction.

Such heat exchangers are used especially for extracting heat from a refrigerant fluid in a motorvehicle air-conditioning installation, and, more particularly, when the refrigerant fluid is one of those which, like $CO_2$, have to be subject to very high pressures, for example of several hundred bar. The manifolds used in the conventional air-conditioning condensers, comprising a tubular wall formed from one or more rolled metal sheets, would not in fact withstand such pressures, and a solid component is required in order to furnish sufficient wall thickness.

However, if the ends of the tubes open out directly into a bore defining the internal volume of the manifold, as they do within the tubular, sheet-metal wall of conventional manifolds, the high wall-thickness of the manifold adds to the space taken up by the tubes in the second direction, correspondingly increasing the overall space required for the heat exchanger.

The object of the invention is to remedy this drawback, and to reduce the overall size of the heat exchanger in the second direction, for a given length of the cross section of the tubes.

The invention especially envisages a heat exchanger of the kind defined in the introduction, and provides for only a part of the length of the cross section of the tubes to project, along the said first direction, into the said internal volume, the leaktightness of the fluid communication between the tubes and the internal volume being obtained by means of a cradle in the form of a profiled strip, accommodating the said body and brazed to it and to the periphery of the tubes.

Optional characteristics of the invention, which are complementary or alternative, are set out below:

- at least one end of the length of the cross section of the tubes projects along the said first direction beyond the bore or the set of bores in the second direction;
- an intermediate part of the length of the cross section of the tubes projects along the said first direction between two bores defining the said internal volume;
- one end of each tube is engaged in a slot formed in the said body, elongate in the second direction, opening out at its two ends and the bottom of which is interrupted by the said internal volume, the said cradle being applied to the body in such a way as to cover over the said slots and exhibiting, opposite them, elongate apertures for the leaktight passage of the tubes;
- each slot features two lateral regions of a reduced depth the bottom of which serves as an abutment for the end of the tube and a deeper central region defining a free space which communicates with the inside of the tube;
- one end of each tube is engaged so as to be leaktight to the fluid in a stamped cup of the cradle, the bottom of which is itself housed in a leaktight way in a transverse notch of the body and traversed by at least one aperture for fluid communication between the tube and the said internal volume;
- the body and the cradle feature means for mutual mechanical fastening;
- the said fastening means comprise two step features extending in the axial direction on the outer surface of the body, respectively on either side of a plane passing through the axes of the tubes, and interacting with teeth of the cradle;
- each tooth is formed at the free end of a lug extending substantially in a radial plane, each lug being interposed in the axial direction between two cups;
- the manifold includes at least one transverse partition delimiting, in the axial direction, at least one chamber which forms part of the said internal volume, engaged in an aperture of the body which is covered over by the cradle;
- the manifold includes at least one transverse partition delimiting, in the axial direction, at least one chamber which forms part of the said internal volume, engaged in an aperture of the body beyond which it protrudes and carrying means for mechanical fastening onto the periphery of the body.

The characteristics and advantages of the invention will be set out in more detail in the description below, by referring to the attached drawings.

Figure 1:
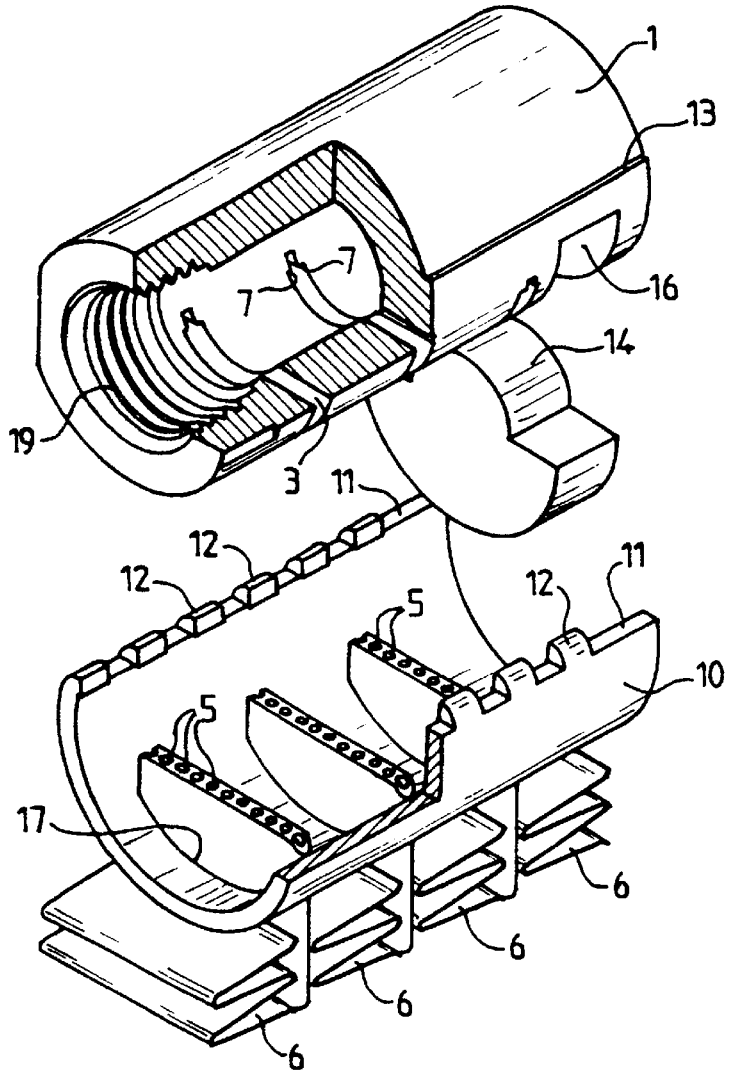
FIG. 1 is a partial view in exploded perspective of a heat exchanger intended for extracting heat from $CO_2$ in the supercritical state at high pressure, used as a refrigerant fluid in a motor-vehicle air-conditioning circuit.
Figure 2:
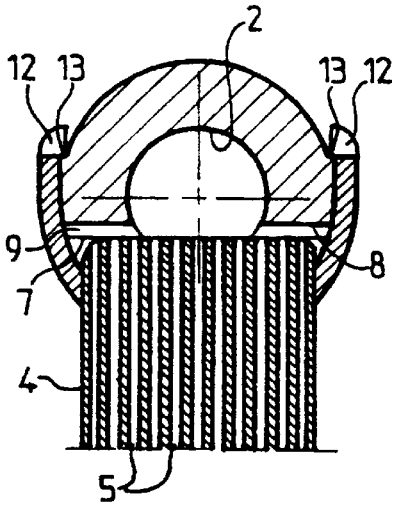
FIGS. 2 and 3 are views in cross section and in axial section respectively of the part of the heat exchanger represented in FIG. 1.
Figure 3:
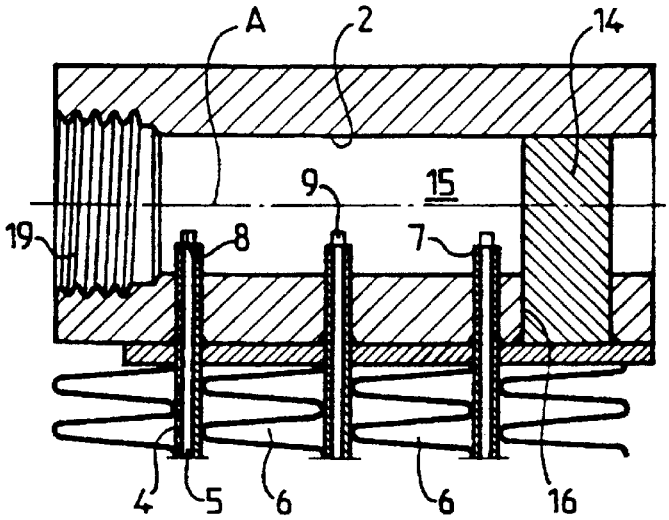

The heat exchanger represented in FIGS. 1 to 3 comprises a manifold formed essentially by a solid metal body 1 having the general external shape of an elongate axisymmetric cylinder. The body 1 is pierced by an axial through-bore 2 which confers on it the form of a thick-walled tube. The body 1 is produced by extrusion, for example.

Transverse slots 3, regularly spaced from one another in the axial direction, are formed in the body 1. Each slot 3 is horizontally elongate, as seen in FIG. 2, and opens out outside the body at its two ends as well as downwards over its entire length. Its bottom is interrupted, furthermore, by the bore 2 which is thus in fluid communication with the slot. Each slot serves to accommodate the upper end of a vertically elongate tube 4, as seen in the figures, and featuring two main faces situated in respective planes perpendicular to the longitudinal axis A of the body 1 and of the bore 2, conferring on it an elongate cross section from left to right in FIG. 2. Each tube 4 is pierced by a multiplicity of longitudinal channels mutually aligned along its width (that is to say along the length of its cross section), these channels defining separate paths for the circulation of the fluid. The tubes 4 are mutually aligned in the direction of the axis A, alternating with spacers 6 each consisting of a corrugated strip, the corrugation crests of a spacer coming into contact alternately with the two tubes which frame it.

According to the invention, the width of the tubes is greater than the diameter of the bore 2, in such a way that only the channels 5 situated in a central region of this width open out directly into the bore 2, while the other channels open out opposite the thick wall of the body 1, on either side of the bore, as is seen clearly in FIG. 2. This results in a reduction in the overall size of the manifold, and consequently of the heat exchanger as a whole, in the direction of the width of the tubes, for a given value thereof. In order to allow both precise positioning of the tubes and effective fluid communication between the marginal channels and the bore 2, the bottom of the slots is situated at two different levels. On each of the longitudinal sides of a slot, the bottom 7 thereof is at a lower level and forms an abutment for the lateral edges of the end of the tube 4. In the central region of the width of the slot, its bottom 8 is at a higher level, consequently spaced away from the end of the tube, so as to define two horizontal ducts 9, on either side of the bore 2, which communicate with the latter at their end and into which the marginal channels of the tube 4 open out.

The ends of the slots 3 open out outside the body 1, and therefore have to be closed off in order to ensure leaktight communication between the channels 5 and the bore 2. To that end, the body 1 rests, by the lower half of its surface, in a cradle 10 made of rolled sheet metal. Each of the lateral edges 11 of the cradle 10 is equipped with a series of teeth 12 which fasten onto a longitudinal step feature 13 provided on the corresponding side of the body 1.

FIGS. 1 and 3 further show a transverse partition 14 which, in the axial direction, delimits at least one chamber 15 within the bore 2. A transverse aperture 16 is formed at the lower part of the body 1 in order to insert the partition 14 and is filled in by the partition in its final position. One or more transverse partitions can thus be provided, in order to limit the internal volume of the manifold axially and/or to divide it into different chambers.

The cradle 10 features transversely elongate apertures 17, of a size which is just sufficient for the Lubes 4 to pass through. The cradle is brazed to the body 1, to the tubes 4 and to the partition 14, by means of a brazing alloy applied, for example, over its entire concave upper surface, thus ensuring leaktightness between the bore 2, the slots 3 and the channels 5 on the one hand, and the outside on the other hand. The partition 14 should, moreover, be brazed to the wall of the bore 2 in order to ensure the leaktight separation thereof.

FIGS. 1 and 3 show a tapping 19 provided at one end of the bore 2 for screwing in a fluid inlet or outlet union.

Figure 4:
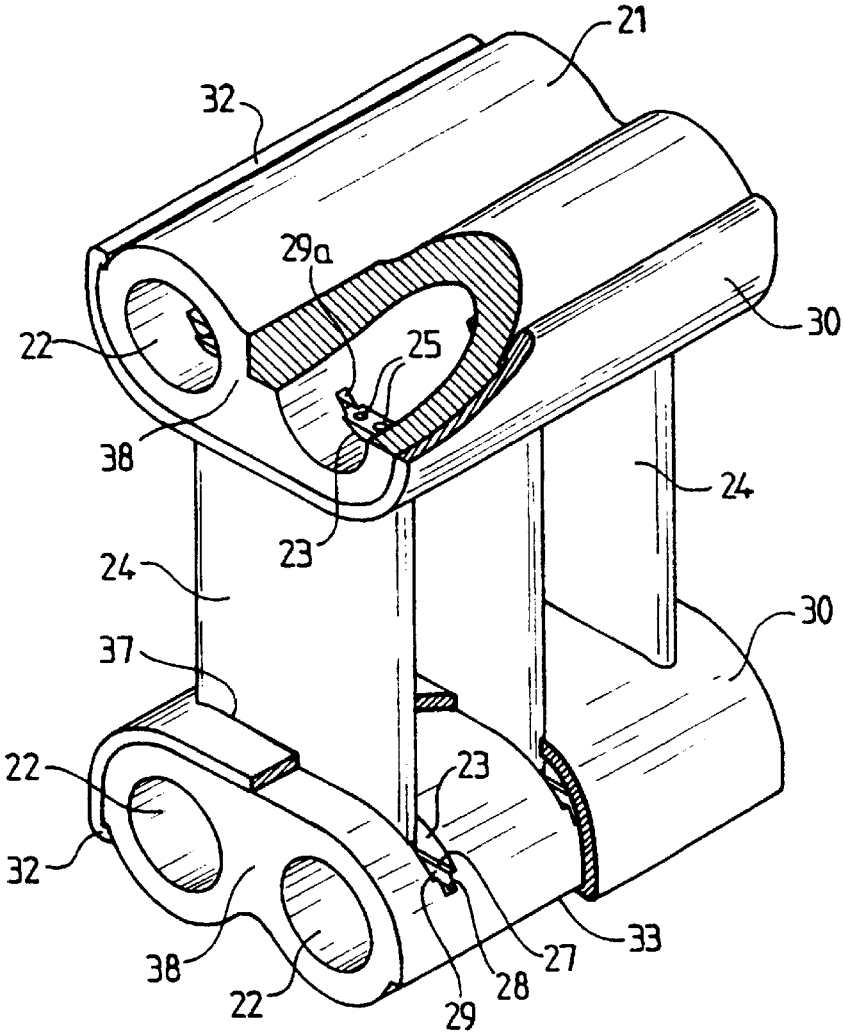
FIGS. 4 and 5 are partial views in perspective of two other heat exchangers according to the invention.

The lower ends, not represented, of the tubes 4 may be in communication with a lower manifold similar to the upper manifold, as is the case in the heat exchanger represented in FIG. 4, where elements similar to those described previously are allocated the same reference numbers increased by 20, and will not be described in detail again.

This second heat exchanger comprises tubes 24 similar to the previously described tubes 4, and two manifolds the bodies 21 of which differ from the body 1 in that each of them features not one but two longitudinal bores 22 the axes of which are parallel and situated in the same horizontal plane, for a vertical orientation of the tubes. The two bores of each body 21 are thus separated from one another by an intermediate longitudinal wall 38. Transverse slots 23, similar to the slots 3, are formed in the bodies. The deepest part of each slot thus defines, in addition to two horizontal ducts 29 each of which is linked to a bore 22 at the adjacent end of the slot, a horizontal duct 29a linking the two bores together, and into which open out the circulation channels 25 situated in a central region of the width of the tube 24. It is also possible to provide for the channels 25 situated in the marginal regions of the width of the tube to open out beyond the bores 22, that is to say in the ducts 29, as is the case for the heat exchanger of FIGS. 1 to 3.

A cradle 30 is associated with each of the manifolds, which, in addition to its shape matched to the width of the body 21, differs from the cradle 10 described above in that the teeth 12 are replaced by rims 32 projecting in the direction of the median longitudinal plane of the heat exchanger and interacting over the entire length of the cradle with a corresponding lateral step feature 33 of the body.

Figure 5:
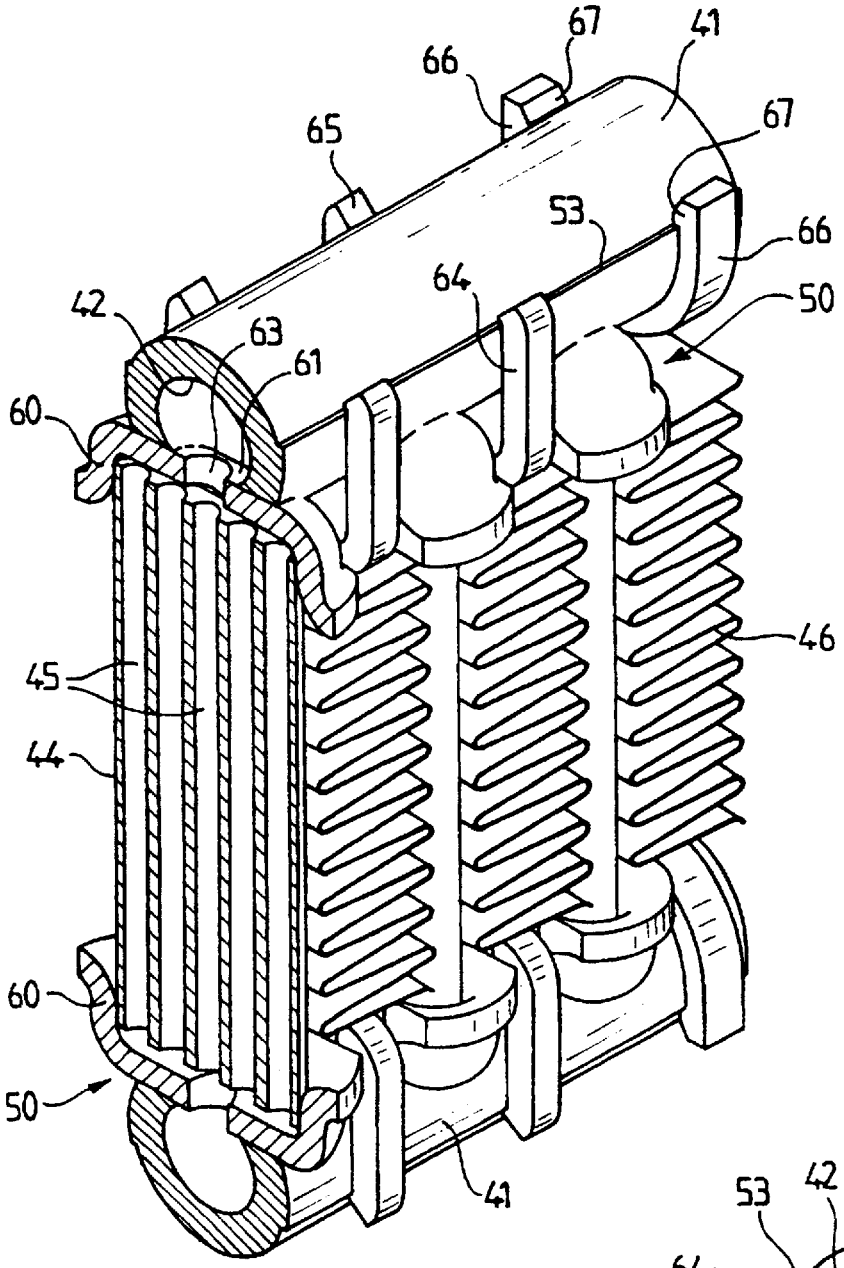
Figure 6:
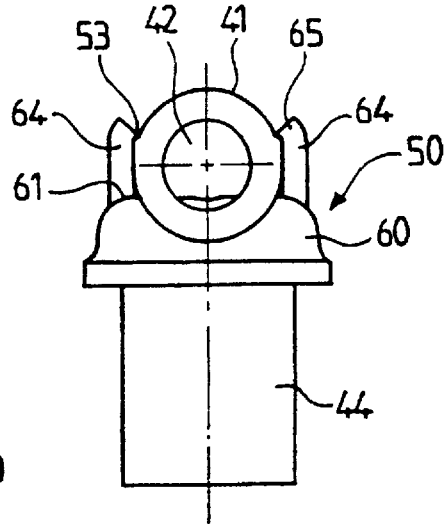
FIG. 6 is a partial end view of the exchanger of FIG. 5.

In FIG. 5, where elements similar to those of FIGS. 1 to 3 are allocated the same reference numbers increased by 40, two manifolds are again represented communicating respectively with the upper and lower ends of vertical tubes 44 similar to the previously described tubes 4 and aligned, like them, alternately with spacers 46. Each manifold comprises a solid body 41 of a generally cylindrical shape similar to that of the body 1, and traversed like it by an axisymmetric cylindrical axial bore 42. A cradle 50 made of stamped sheet metal is associated with each body 41. Each end of the tubes 44 is capped by a cup 60 formed by stamping of the cradle, the bottom 61 of this cup fitting into a transverse notch 62 of the body 41, which communicates with the bore 42 and which opens out at its ends onto the two sides of the body. An aperture 63 passing through the bottom 61 at its centre allows fluid communication between the bore 42 and the channels 45 of the tube, the leaktightness of this communication being ensured by brazing the cup by its inner face to the periphery of the tube and by the outer face of its bottom to the notch 62 of the body.

The mechanical fastening of each cradle 50 onto the corresponding body 41 is achieved by means of lugs 64 belonging to the cradle, arranged in pairs on either side of the body, the pairs of lugs being arranged alternately with the cups 60. Each lug 64 is turned away from the spacer 66, that is to say upwards in the case of the upper cradle and downwards in the case of the lower cradle, and terminates in a tooth 65 which protrudes in the direction of the axis of the body so as to interact with a longitudinal step feature 53 thereof, in the same way as the teeth 12 of the heat exchanger of FIGS. 1 to 3.

Figure 7:
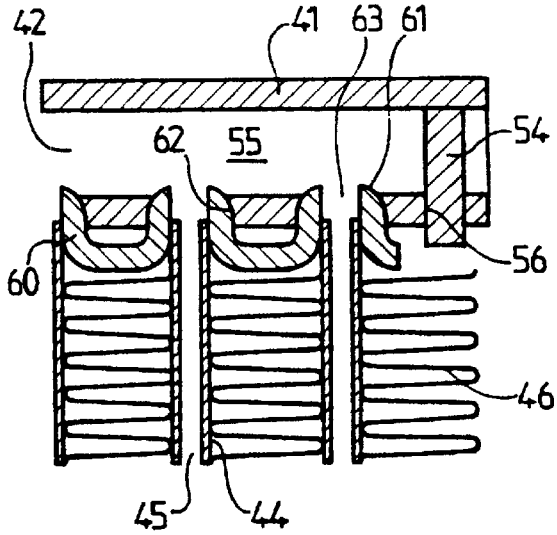
FIGS. 7 and 8 are partial views in longitudinal section and from the side of this same exchanger.
Figure 8:
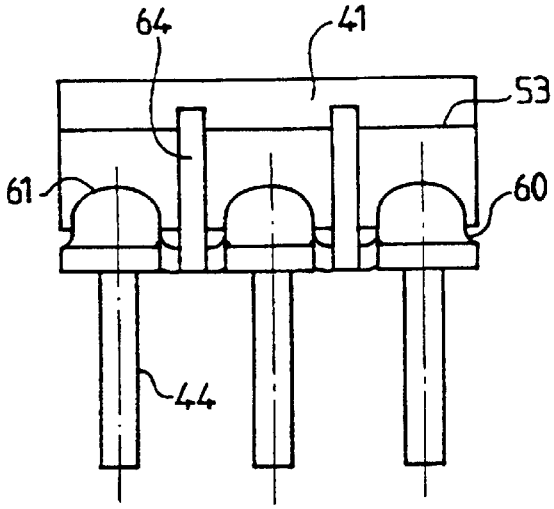

A transverse partition 54 is seen in FIG. 7, which is inserted in the same way as the partition 14 of FIGS. 1 to 3 through an aperture 56 of the body 41, this aperture being turned towards the tube bank, so as to delimit a chamber 55 in the bore 42. In its final position, this partition protrudes beyond the aperture 56, so as the form the start base for two lugs 66 which extend in the circumferential direction along the body 41 as far as the step features 53, onto which they are fastened by terminal teeth 67 which act in the same way as the teeth 65.

What is claimed is:

1. Heat exchanger for extracting heat from a refrigerant fluid in a motor-vehicle air-conditioning installation, comprising at least one manifold an internal volume of which is defined by at least one longitudinal bore (2) formed in an elongate solid body (1), and is in fluid communication with a row of tubes (4) which are mutually aligned in an axial direction of the at least one bore, elongate parallel to one another in a first direction substantially perpendicular to the axial direction and having an elongated cross section in a second direction substantially perpendicular to the axial direction and substantially perpendicular to the first direction, wherein only a part of the length of the cross section of the tubes projects, along the first direction, into the internal volume, the leaktightness of the fluid communication between the tubes and the internal volume being obtained by means of a cradle (10) in the form of a profiled strip, accommodating said body and brazed to it and to the periphery of the tubes, and wherein one end of each tube is engaged in a slot (3) formed in said body, elongate in the second direction, opening out at its two ends and the bottom of which is interrupted by the internal volume, said cradle being applied to the body in such a way as to cover over the slots and exhibiting, opposite them, elongate apertures (17) for the leaktight passage of the tubes.

2. Heat exchanger according to claim 1, in which at least one end of the length of the cross section of the tubes (4; 24) projects, along said first direction, beyond the at least one bore (2, 22) in the second direction.

3. Heat exchanger according to claim 1, in which an intermediate part of the length of the cross section of the tubes projects, along said first direction, between two bores (22) defining said internal volume.

4. Heat exchanger according to claim 1, in which each slot features two lateral regions of a reduced depth the bottom (7) of which serves as an abutment for the end of the tube and a deeper central region defining a free space (9) which communicates with the inside of the tube.

5. Heat exchanger according to claim 1, in which the body and the cradle feature means (12, 13) for mutual mechanical fastening.

6. Heat exchanger according to claim 5, in which said fastening means comprise two step features (13) extending in the axial direction on the outer surface of the body, respectively on either side of a plane passing through the axes of the tubes, and interacting with teeth (12) of the cradle.

7. Heat exchanger according to claim 1, in which the manifold (1) includes at least one transverse partition (14) delimiting, in the axial direction, at least one chamber (15) which forms part of said internal volume, engaged in an aperture (16) of the body which is covered over by the cradle (10).

8. Heat exchanger according to claim 1, wherein the elongated cross section defining a width of the tubes is greater than the diameter of the at least one bore.

* * * * *